United States Patent [19]

Bavin

[11] 4,443,164

[45] Apr. 17, 1984

[54] SECONDARY SPEED SENSOR FOR GOVERNED AIR GRINDERS

[75] Inventor: Lowell R. Bavin, West Unity, Ohio

[73] Assignee: The Aro Corporation, Bryan, Ohio

[21] Appl. No.: 358,305

[22] Filed: Mar. 15, 1982

[51] Int. Cl.[3] ..... F01C 21/12; F04C 15/02

[52] U.S. Cl. ..... 418/41; 137/53; 415/503; 418/43

[58] Field of Search ..... 418/41, 42, 43; 137/56, 137/57, 53; 417/294; 416/51 A, 51 R, 52 A, 52 R; 415/36, 503

[56] References Cited

U.S. PATENT DOCUMENTS

| | | | |
|---|---|---|---|
| 1,384,113 | 7/1921 | Arnold . | |
| 2,586,968 | 2/1952 | MacClay . | |
| 2,973,771 | 3/1961 | Barth et al. . | |
| 3,071,115 | 1/1963 | Schott . | |
| 3,519,372 | 7/1970 | Peale | 418/43 |
| 3,749,530 | 7/1973 | Amador | 418/41 |
| 3,767,332 | 10/1973 | Wickham et al. | 418/43 |
| 3,930,764 | 1/1976 | Curtiss | 137/57 |
| 4,184,819 | 1/1980 | Clark | 418/43 |
| 4,278,103 | 7/1981 | Giardino | 137/50 |
| 4,298,317 | 11/1981 | Hansson | 418/43 |

*Primary Examiner*—Leonard E. Smith
*Assistant Examiner*—T. Olds
*Attorney, Agent, or Firm*—Allegretti, Newitt, Witcoff & McAndrews, Ltd.

[57] ABSTRACT

The present invention comprises a combined speed sensor and control valve for a rotary fluid motor such as a rotary vane air motor. Weights are pivotally attached to the opposite sides of the rotating output shaft of the air motor and are spring biased into engagement with an annular valve disc member positioned over the air inlet. Upon excessive speed of the shaft, the weights swing from engagement with the valve disc member and release the member. Air flow and air pressure within the air inlet passage cause the disc member to translate axially along the rotary shaft and close the air inlet. The air motor must be disassembled and the overspeed control reset prior to continued operation of the air motor.

4 Claims, 5 Drawing Figures

SECONDARY SPEED SENSOR FOR GOVERNED AIR GRINDERS

BACKGROUND OF THE INVENTION

This invention relates to a combined speed sensor and control valve for a rotary fluid motor. The speed sensor and control valve may be incorporated with the rotary shaft of a rotary vane air motor to effect cutoff of air supply to the motor in the event the speed of the motor becomes excessive.

The use of governors for speed control of rotary vane air motors is well known. Additionally, speed sensor devices associated with the rotary shaft of an air motor, known as overspeed controls, are utilized to terminate air flow to air motors in the event that excessive speeds occur due to some failure in the governor.

Patents disclosing various methods for providing overspeed control for rotary vane air motors include U.S. Pat. No. 3,767,332. That patent discloses positioning of weights on opposite sides of a rotating output shaft of an air motor. At rotational speeds below a preselected level the weights remain positioned tightly against the shaft. When the rotational speed of the shaft exceeds a preselected level, the weights are drawn radially outwardly due to the centrifugal force. As the weights swing outwardly, they engage a trigger mechanism which, in turn, operates a mechanical linkage to terminate a supply of air to the air motor. U.S. Pat. No. 2,586,968 and U.S. Pat. No. 3,591,372 disclose similar mechanisms.

U.S. Pat. No. 3,749,530 discloses yet another approach utilizing the centrifugal force associated with the rotating shaft of an air motor. In U.S. Pat. No. 3,749,530, a bellville spring is deflected by centrifugal force to a position which will close air inlet passages in the event of excessive speed of the output shaft of the air motor. U.S. Pat. No. 2,973,771 and U.S. Pat. No. 1,384,113 are of a similar nature. U.S. Pat. No. 4,298,317 appears to combine features of U.S. Pat. No. 3,749,530 and U.S. Pat. No. 3,071,115 discussed below.

U.S. Pat. No. 4,184,819 discloses yet another overspeed control mechanism wherein a member may be displaced from a latched position by centrifugal force to close a shutter for the air supply to the air motor. U.S. Pat. No. 4,278,103 discloses an overspeed control wherein a split ring is released from a cage upon excessive speed of a rotary shaft. The split ring then moves to block air inlet passages to the air motor.

U.S. Pat. No. 3,071,115 discloses an overspeed control device for an air motor wherein weights on opposite sides of a rotating shaft move in response to excessive centrifugal force and release a closure member which acts to close the air inlet to the rotary vane air motor.

The reference patents disclose speed sensor and speed control devices that provide adequate overspeed safety control. However, a device of simpler construction with fewer parts that is less expensive to manufacture, easy to service and sensitive to various speed settings is a desirable product.

SUMMARY OF THE INVENTION

Briefly the present invention comprises a combined speed sensor and control valve for a rotary fluid motor such as a rotary vane air motor. Weights are pivotally attached to the opposite sides of the rotating output shaft of the air motor and are spring biased in to engagement with an annular valve disc member positioned over the air inlet. Upon excessive speed of the shaft, the weights swing from engagement with the valve disc member and release the member. Air flow and air pressure within the air inlet passage cause the disc member to translate axially along the rotary shaft and close the air inlet. The air motor must be disassembled and the overspeed control reset prior to continued operation of the air motor.

Thus, it is an object of the present invention to provide an improved combined speed sensor and control valve for a rotary fluid motor.

It is a further object of the present invention to provide an air motor speed sensor and control valve constructed to detect the threshold speed of the rotary shaft of the air motor and also provide means to close the air inlet to the air motor upon excessive rotary speed of the shaft.

A further object of the present invention is to provide a combined speed sensor and control valve for a rotary fluid motor which has a positive air inlet closing action that is not susceptible to contamination or dirt.

Still a further object of the present invention is to provide a combined speed sensor and control valve for a rotary fluid motor which is of simple and economic construction and which can easily be incorporated with existing rotary fluid motors.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
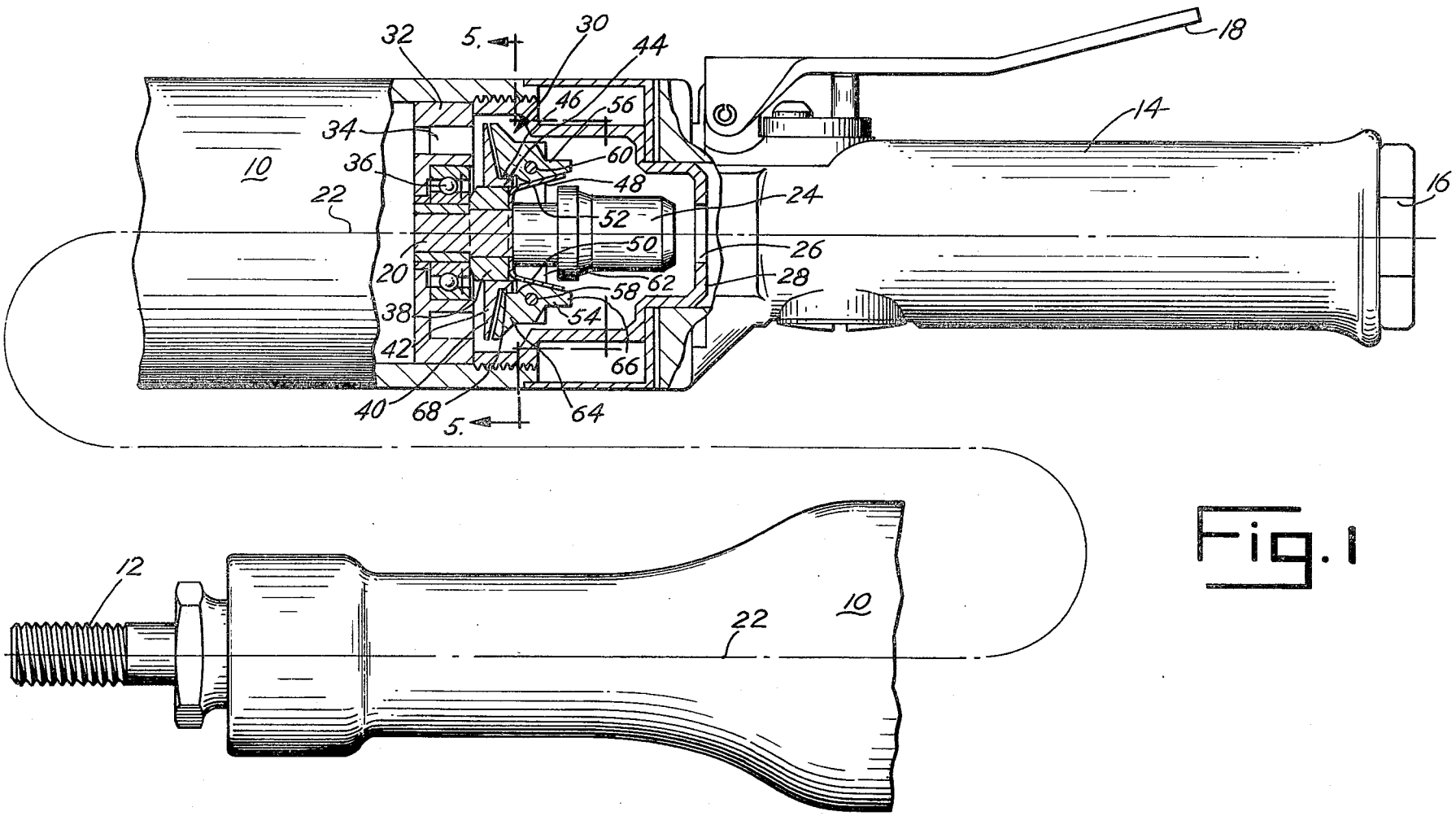
FIG. 1 is a side and partial sectional view illustrating the improved speed sensor and control valve of the present invention as incorporated in a rotary vane air motor driven tool.

Referring to the figures and in particular FIG. 1, the tool shown in FIG. 1 constitutes a grinder. That grinder includes a handle 14 with a lever throttle 18. A grinder spindle 12 rotates when an air supply line is attached to the handle 14 and the throttle lever 18 is depressed. The speed of the grinder and thus the speed of the rotary vane air motor within a housing 10 is controlled by a governor valve 24 which cooperates with an air inlet opening 26 through an air inlet chamber housing 28. The governor valve 24 thus translates axially and may be of any desired governor construction sensitive to the rotational speed of the shaft 20.

The present invention relates to a secondary speed sensor and control valve 30 which is interposed between a support end plate 32 of the rotary vane air motor and the governor valve 24 on the shaft 20. Shaft 20 rotates on axis 22. The end plate 32 is affixed to the housing 10 and includes an air inlet passage 34 therethrough to the rotary vane motor. Bearings 36 are provided for rotation of motor shaft 20 in the plate 32. A bushing 38 rotates wih the shaft 20 and maintains the shaft 20 against axial movement.

Positioned on the shaft 20 over the bushing 38 is an annular valve disc member 40. The annular valve disc member 40 includes a disc section 42 having a maximum radial dimension from the axis 22 which is greater than the maximum radial extent of the inlet passage 34 from the axis 22. In this manner the valve member 40 which is slidable on the bushing 38 will cover the inlet 34. The valve member 40 also includes a circumferential flange 44 which defines a groove 46.

A biasing means or spring 48 having cantilever spring arms 50 and 52 is positioned on the shaft 20 and retained against the bushing 38 by the governor valve assembly 24. The spring or biasing means 48 is biased against opposed weights 54 and 56 which are mounted respectively on pivot pins 58 and 60. The pivot pins 58 and 60 extend across respective slots in a weight support housing 62. Thus, the weights 54, 56 are supported for pivotal movement about the pins 58 and 60 within slots in the housing 62. Each weight, for example weight 54, includes a first or lower wing 64 and a second or upper wing 66. Wings 64, 66 extend in generally opposite directions with respect to each other about the pivot 58. The lower wing 64 defines a mass which is responsive to centrifugal force resulting from the spin of shaft 20. The lower wing 64 also includes a latching member 68 which engages with the flange 44 to hold the disc member 40 in position on the bushing 38. The spring 50 thus engages the wing 66 and causes the latch 68 to engage the flange 44.

Figure 2:
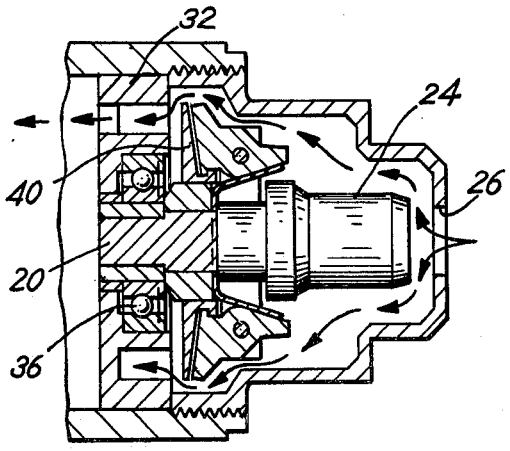
FIG. 2 is a side cross sectional view of a portion of the mechanism shown in FIG. 1 operating at normal speed.

FIG. 1 represents the configuration of the sensor when the tool is in the rest position, i.e., no air is supplied to the air motor. FIG. 2 represents operation of the tool when air has been provided through the inlet 26 and the speed of the motor is being appropriately controlled by the governor 24. Note that the weights 54, 56 do not spin at a sufficiently high rate to be released from the flange 44. Thus, air flows in the path indicated by the arrows through the passage associated with air inlet 34 to the air motor.

Figure 3:
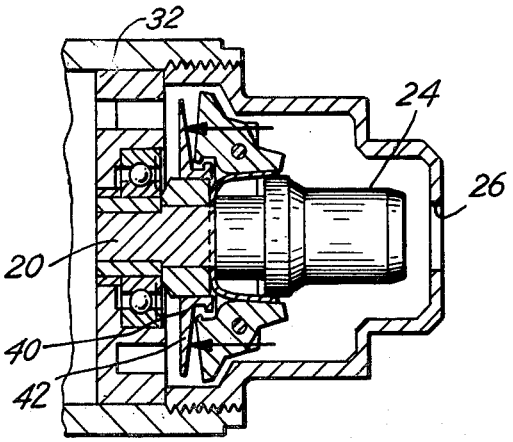
FIG. 3 is a side cross sectional view similar to FIG. 2 wherein the air motor is operating at excessive speed.

FIG. 3 illustrates the situation when excessive speed of shaft 20 occurs. The mass associated with wing 64 causes the weight 54 to pivot outwardly against the force of the spring 50. This releases the latch 68 from the flange 44. The same release is effected with the weight 56. As a result, referring to FIG. 4, the disc member 42 is released, translates along axis 22 and impinges against the inlet 34 thereby terminating and closing air flow.

Figure 4:
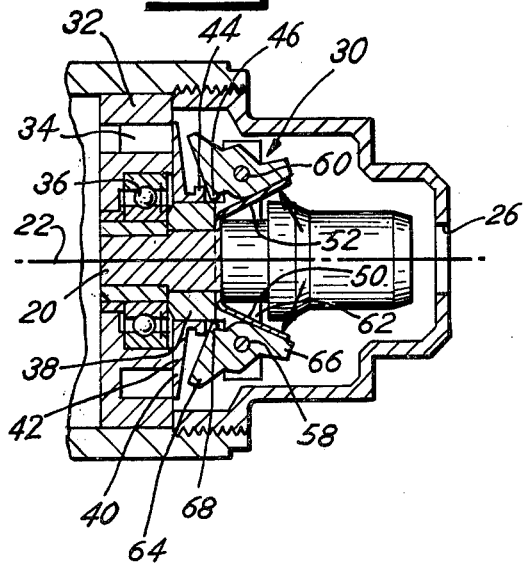
FIG. 4 is a side cross sectional view similar to FIG. 3 wherein the speed sensor and control valve have moved to the closed position in response to excessive speed.
Figure 5:
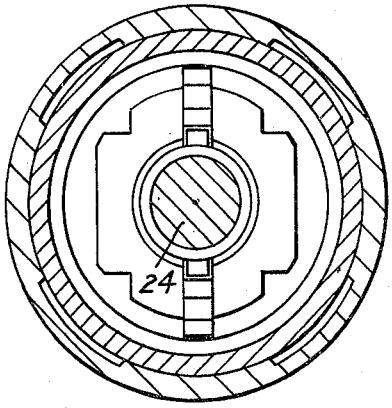
FIG. 5 is an end cross sectional view taken substantially along the line 5—5 in FIG. 1.

Note that the spring 48 acts against the weights 54 and 56 when air flow is terminated to cause the weights 54 and 56 to pivot back to a rest position as shown in FIG. 4. This locks the disc member 42 into the closed position. The air motor and unit must thereby be disassembled and repaired and reset before use can again commence.

With the structure of the present invention, any contamination of the air should not affect the operation and integrity of the secondary speed sensor since air and contaminants flow over the outer boundaries and away from all of the bearing points of the respective parts. Moreover, the centrifugal force associated with the rotating shaft will tend to cause contaminants to be thrown outwardly away from the rotating and moving parts associated with the control device of the present invention thereby eliminating operational interference. Also note that if the spring 48 fails to provide a spring force, the weights 54, 56 will rotate outwardly and will cause the disc 42 to close the inlet 34 thereby terminating operation of the device. This again is a safety feature of the device. The fact that the device of the present invention is less susceptible to contamination differentiates it significantly from the prior art references particularly the reference to Schott, U.S. Pat. No. 3,071,115 which is incorporated herewith by reference.

Thus, while there has been set forth a preferred embodiment of the invention, it is to be understood that the invention is to be limited only by the following claims and their equivalents.

What is claimed is:

1. A combined speed sensor and control valve for a rotary fluid motor of the type including a rotary shaft having a center line rotation axis, a fluid inlet for supplying fluid to the motor radially spaced from the shaft and shaft axis, said sensor and valve comprising, in combination:

a fluid inlet passage extending in the direction of the shaft for fluid flow into the inlet;

an annular valve member slidably mounted on the shaft for movement along the axis, said valve member including a disc portion extending radially from the shaft for a distance at least equal to the maximum radial extent of the fluid inlet from the center line axis of the shaft, said valve member being positioned upstream from the fluid inlet; said valve member also including a circumferential latching flange upstream from the disc portion;

at least one pivotally mounted speed sensor weight attached to the shaft, said weight being pivotal about a weight axis transverse to the shaft axis, said weight including a flange engaging latch cooperative with the valve member flange, biasing means engaging and biasing the weight about the weight axis into engagement with the valve member flange to maintain the valve member in the open position; said weight also including a mass distributed radially from the shaft axis and radially movable in response to shaft rotation beyond a threshold value in opposition to the force of the biasing means thereby releasing the valve member by simultaneous disengagement of the latch from the flange and fluid flow force on the disc causing axial movement of the valve member to cover the fluid inlet, said weight having a first wing extending in one direction from the weight pivot axis and a second wing extending in the generally opposite direction from the weight pivot axis, the first wing including the latch and mass, the second wing being cooperative with the biasing means.

2. The apparatus of claim 1 including two weights, one on each side of the shaft.

3. The apparatus of claim 1 wherein the biasing means comprise a cantilever spring attached to the shaft and engaging the second wing.

4. The apparatus of claim 1 wherein the cantilever spring continuously biases the weights upon release of the valve member to lock the valve member in a closed position after said valve member moves by axial movement to the closed position.

* * * * *